US005344242A

United States Patent [19]

Farb

[11] Patent Number: 5,344,242

[45] Date of Patent: Sep. 6, 1994

[54] PRINTER HAMMERBANK WITH LOW RELUCTANCE MAGNETICS

[75] Inventor: Norman E. Farb, Villa Park, Calif.

[73] Assignee: Printronix, Inc., Irvine, Calif.

[21] Appl. No.: 987,378

[22] Filed: Dec. 8, 1992

[51] Int. Cl.[5] ..... B41J 2/245

[52] U.S. Cl. ..... 400/124.2; 101/93.04; 101/93.29

[58] Field of Search ..... 400/124, 121, 157.2; 101/93.04, 93.29

[56] References Cited

U.S. PATENT DOCUMENTS

| | | | |
|---|---|---|---|
| 4,037,704 | 7/1977 | Golobay | 400/124 |
| 4,367,677 | 1/1983 | Mielke | 400/124 |
| 4,585,361 | 4/1986 | West et al. | 400/124 |
| 4,882,987 | 11/1989 | Sakai et al. | 101/93.04 |
| 4,886,381 | 12/1989 | Kersey | 400/124 |
| 5,046,871 | 9/1991 | Saitou et al. | 400/124 |
| 5,150,976 | 9/1992 | Hilkenmeier et al. | 400/124 |
| 5,152,217 | 10/1992 | Farb et al. | 101/93.04 |

*Primary Examiner*—Edgar S. Burr
*Assistant Examiner*—John S. Hilten
*Attorney, Agent, or Firm*—George F. Bethel; Patience K. Bethel

[57] ABSTRACT

The specification describes a low reluctance magnetic circuit for a dot matrix line printer for retaining hammersprings by the magnetic circuit having pairs of pole pieces formed of magnetically conductive sheets having a space for receipt of a permanent magnet. A coil is wrapped around a portion of each of the pole pieces between the magnet and the ends to provide a reverse magnetic field to the magnetic field provided by the permanent magnet. A magnetic shunt is established between the pole pieces to provide a greater magnetic effect. The pole pieces are sized and plated at the ends, with a spaced wear bar between them to provide improved performance and longer wear.

27 Claims, 4 Drawing Sheets

PRINTER HAMMERBANK WITH LOW RELUCTANCE MAGNETICS

FIELD OF THE INVENTION

The field of this invention lies within the dot matrix printing art. It specifically is directed toward the dot matrix printing art as it pertains to hammersprings having a retention permanent magnet and an electrical coil for release of stored mechanical energy in the hammerspring. The hammerspring can be released from a retracted position provided by the retention of the permanent magnet. This results in a printed dot impressed by a small cylinder or rod against an inked ribbon, which presses against a piece of paper making a printed dot.

These printers are more specifically known for uses as line printers. The line printers have a hammerbank of multiple hammersprings with the rods in an array which move across a piece of paper to be printed upon with commands to provide a printed output on the paper.

BACKGROUND OF THE INVENTION

The dot matrix printers of the prior art which use a hammerbank of hammersprings with a permanent magnet and an electrical coil have provided high speed printing. The high speed printers provided by such dot matrix printers create an output which is formed from a series of dots. These printers are well known in the art and many patents describing them have been assigned to the applicant's assignee herein, namely Printronix, Inc. However, none describe the advanced magnetics and hammerbank of this invention.

During the operation of such printers, it is necessary to store energy by retaining the hammerspring against a source of permanent magnetism. The hammerspring is then released with an electrical coil overcoming the magnetic circuit retaining the hammerspring into its stored energy relationship. The result is the printing of a dot on a paper by impressing a small cylinder or rod against an inked ribbon.

The stored potential energy of the hammerspring is released when a reverse or counter flux overcoming the permanent magnet's flux is allowed to be created through an electrical coil. When creating the reverse flux through the electrical coil, electrical energy in the form of a current is utilized. As can be appreciated, the coils have a tendency to heat when current flows through them. This invention specifically reduces the amount of current and thereby excess heat generated within the coils.

Another disadvantage of the prior art is that the mechanical energy of a hammerspring when in the printing mode causes it to return to the pole pin with a degree of excess kinetic energy. This excess kinetic energy creates a wearing effect or unwanted impact on the magnetic circuit and the steel of the hammersprings and the pole pieces upon impact. This wear has been greatly reduced by this invention through a wear bar with a hard, low friction coating at the interface between the hammerspring and the wear bar.

A further advantage of this invention is that the overall design of the frame and multiple magnetic circuits are such that there is no steel in contact with any of the neighboring magnetic circuits. Thus, magnetic interaction is very low. The frame is made from non-ferrous alloys. Potting material of a non-conducting non-magnetic nature is also used. The hammersprings can be released or fired independently in a uniform manner to avoid different densities of dots regardless of the dot's spacing densities, or the printed subject matter.

Pole pins and the creation of a magnetic circuit from a permanent magnet in the prior art was generally provided by a solid series of pins. The pole pins of this invention are made by using sheets of low hysteresis, high saturation, low carbon silicon iron laminations welded together. These laminations or sheets when welded together at the hammerspring interface help to avoid arcing and discharge which tends to pit the face of the hammerspring and the pole pieces. Additionally, the relatively soft material of the pole pieces is protected from impact by using the anti-wear bar to absorb the impact energy as referred to hereinbefore.

The welding across the shorted ends of the magnetic pole pin faces prevents arcing. Furthermore, the pole pins when made from the laminations prevent eddy currents of a nature that would require increased energy. Thus decreased energy requirements are manifest in the design through the reduction of the eddy currents within the laminated pole pins.

When the hammersprings move away from the ends of the pole pins, the pole pins are subject to a change in magnetic flux. An arcing is encountered unless they are grounded. In order to avoid the arcing, the pole pieces are grounded to the hammersprings through the frame of the hammerbank.

In order to provide for sufficient magnetic energy to retract the hammersprings and at the same time allow for release thereof by the current through the coils overcoming the permanent magnetic force, a trade-off must be established. This trade-off is established through the size of the permanent magnet, the shunt gap, the air gap and the relative permeabilities. This has been established in an optimum manner by this invention when considering the required magneto motive force (mmf) and flux densities along with the numerous permeabilities of the non-parallel air gaps.

The trade-off for the improvement of reluctance is a resulting increase in iron weight and magnetic volume. Thus, the mass of the entire printer or hammerbank as it moves is such wherein it has to be accounted for. Nevertheless, when considering the lower temperatures required, the faster reaction time and overall lessening of heat and more accurate printing, the establishment of this invention with respect to its design is a significant step over the art.

It has been found that the initial magnetic reluctance has been decreased by a significant amount with respect to the prior art non-shunt designs. Thus, when considered in light of the prior art, this invention is a significant advance thereover and will be seen to be unique and patentable as established through the specification set forth hereinafter.

SUMMARY OF THE INVENTION

In summation, this invention comprises a low reluctance highly efficient magnetic system requiring decreased energy requirements with attendant lower heat for a highly responsive hammerspring in a hammerbank for a dot matrix line printer.

More particularly, it incorporates a low reluctance magnetic system having a plurality of sandwiched high permeability sheets forming a magnetic path for a permanent magnet through pole pieces. The pole piece ends are provided with a chrome plating for reduction of impact, and arcing wear thereon. Between the pole pieces, an impact anti-wear bar is provided which has a coating to limit the wear thereon.

Each hammerspring that is retracted and held by the permanent magnetic in close juxtaposition to the pole pieces is held in a flexed condition to store potential energy. This is established by the permanent magnet so that upon release, the kinetic energy provides the printing.

The magnetic force path through the pole pieces is overcome by a pair of coils zeroing the flux established by the permanent magnet. This is accomplished through an optimum air gap design. A shunt, which has been established for the flux path while at the same time reducing the eddy currents through a sandwiched array of laminations forming the pole pieces substantially enhances the magnetic force path.

Each of the two pole pieces are welded at their ends to prevent discharging and arcing through the change of magnetic energy upon release of the hammersprings. Additionally, the pole pieces are grounded to the hammersprings to prevent arcing through the gaps between the hammersprings and the pole pieces.

The hammersprings and pole pieces are respectively coated with a high wear high resistance metallic coating. This limits wear thereon and the reduction of pitting and metal removal so that consistent hammerspring operation and consistent printing take place.

All the foregoing features allow the invention hereof to overcome the prior art deficiencies through the optimum design hereof with its permeability, shunt, low reluctance nature and low energy and heat consumption attendant with improved printing and hammerspring operation.

DESCRIPTION OF THE PREFERRED EMBODIMENTS

Figure 1:
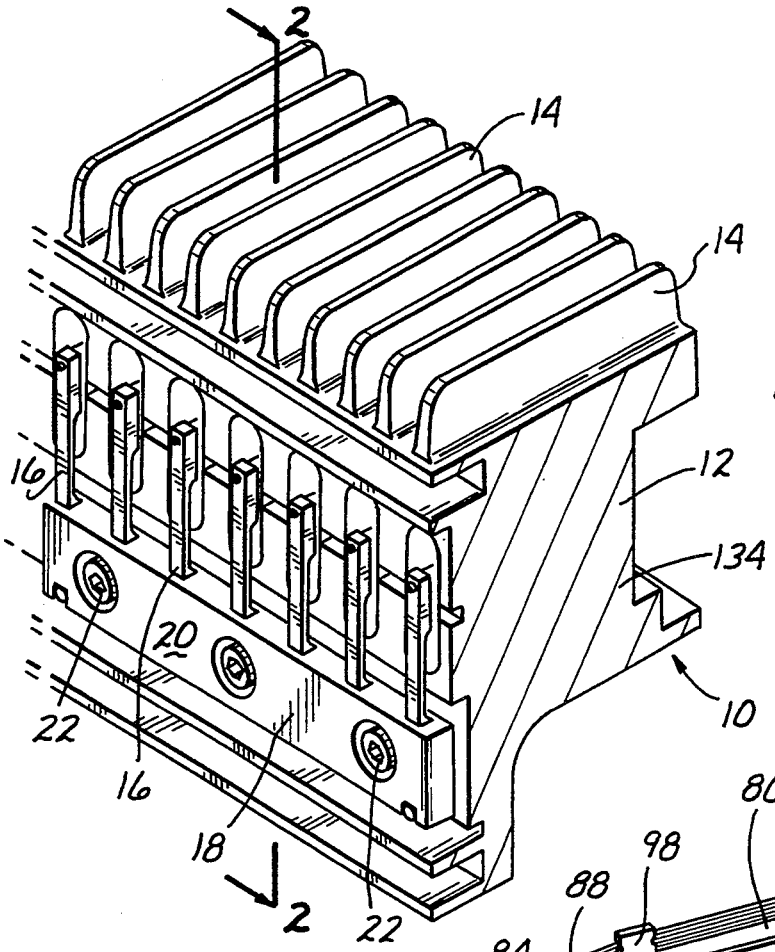
FIG. 1 shows a perspective view of a fragmented portion of a hammerbank of this invention with the hammersprings in a plural relationship on a fret of hammersprings.

Looking at FIG. 1, a hammerbank 10 is shown. The hammerbank 10 moves in an oscillatory manner across a print station for purposes of printing on a piece of paper moving over a platen. A description of the operation of the hammerbank 10 can be exemplified in a co-pending U.S. Patent Application of the inventor hereof and James Chon and other patents of the assignee of this invention, namely Printronix, Inc.

The hammerbank 10 is formed with a magnesium, aluminum, or other non-magnetic alloy, or non-magnetic material such as fibrous reinforced plastics, in the form of an elongated block or structure 12. The hammerbank structure has fins 14 which provide cooling to the hammerbank.

In association with the hammerbank, are a series of hammers 16 that are shown connected to a fret 18. The fret or plurality of hammersprings 16 are formed as one continuous member with the fret 18. The fret 18, supports a plurality hammersprings 16, in this case, a total of seven (7). The hammersprings 16 are sufficiently mechanically isolated to avoid interaction through a base 20 of the fret 18.

The fret 18 is secured to the hammerbank block or structure 12 by screws 22 that are seen as three (3) screws for securement of the fret 18 to the hammerbank 12. This provides a mechanically solid connection.

Figure 7:
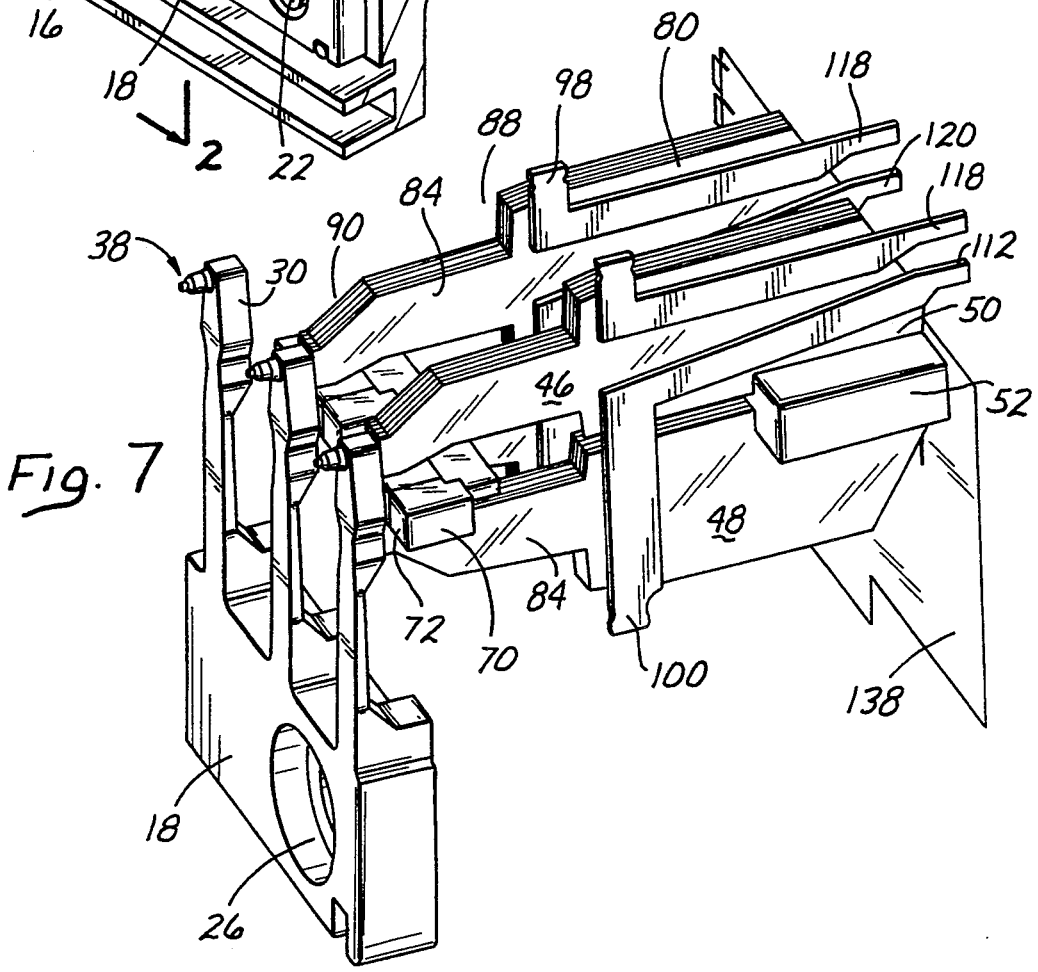
FIG. 7 shows a perspective view of two pairs of pole pieces in operative relationship to their respective hammers without the coils thereon and without any potting.
Figure 2:
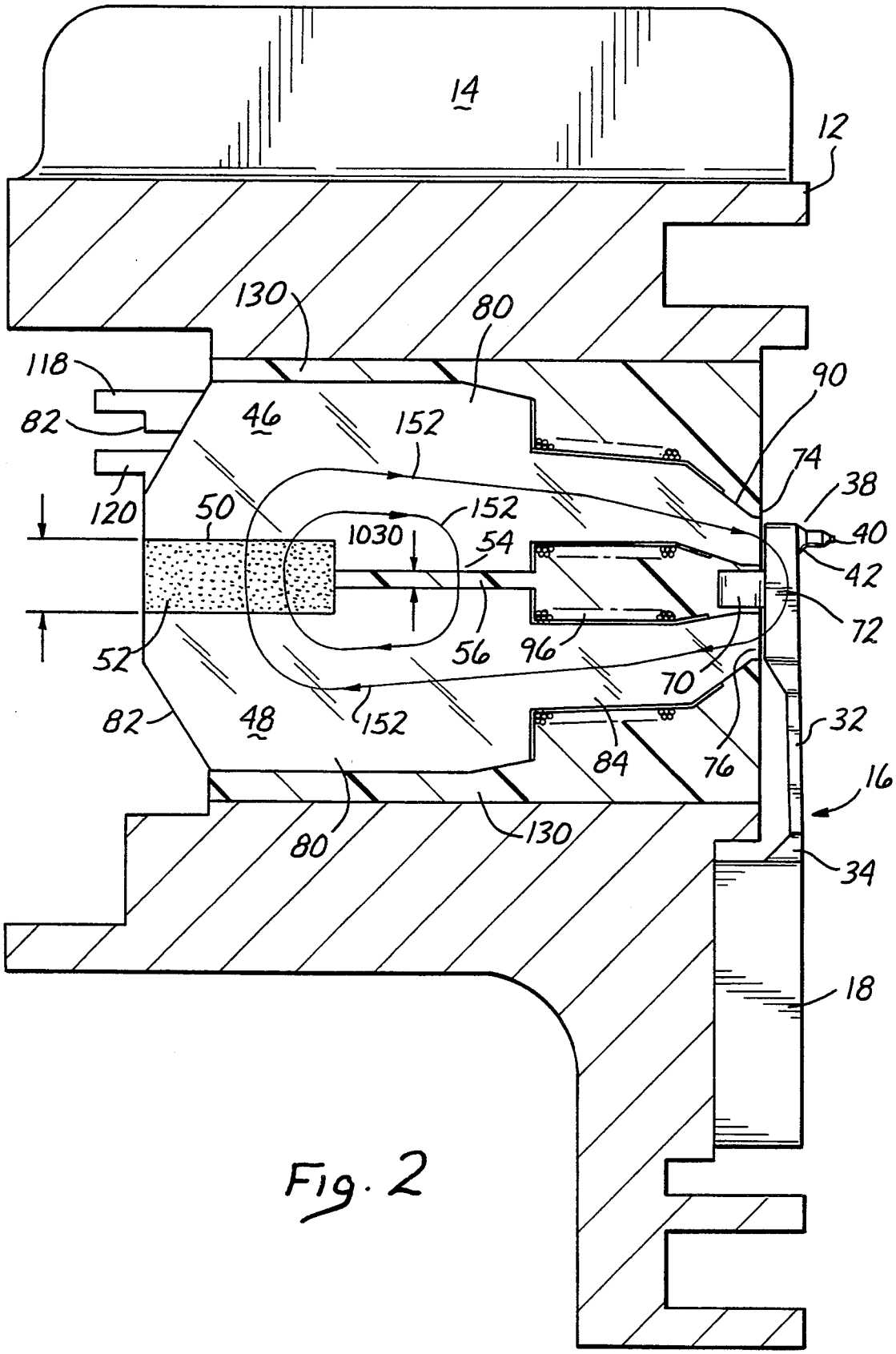
FIG. 2 shows a cross sectional view of the hammerbank of this invention along line 2—2 of FIG. 1, with the pole pieces, magnet, and coils potted and in position within the hammerbank, with the hammerspring magnetically retained.

The fret 18 can be seen with an opening 26 in FIG. 7 in the exploded view thereof for purposes of receiving the screws 22 for securing the fret 18 against the hammerbank block 12.

Figure 6:
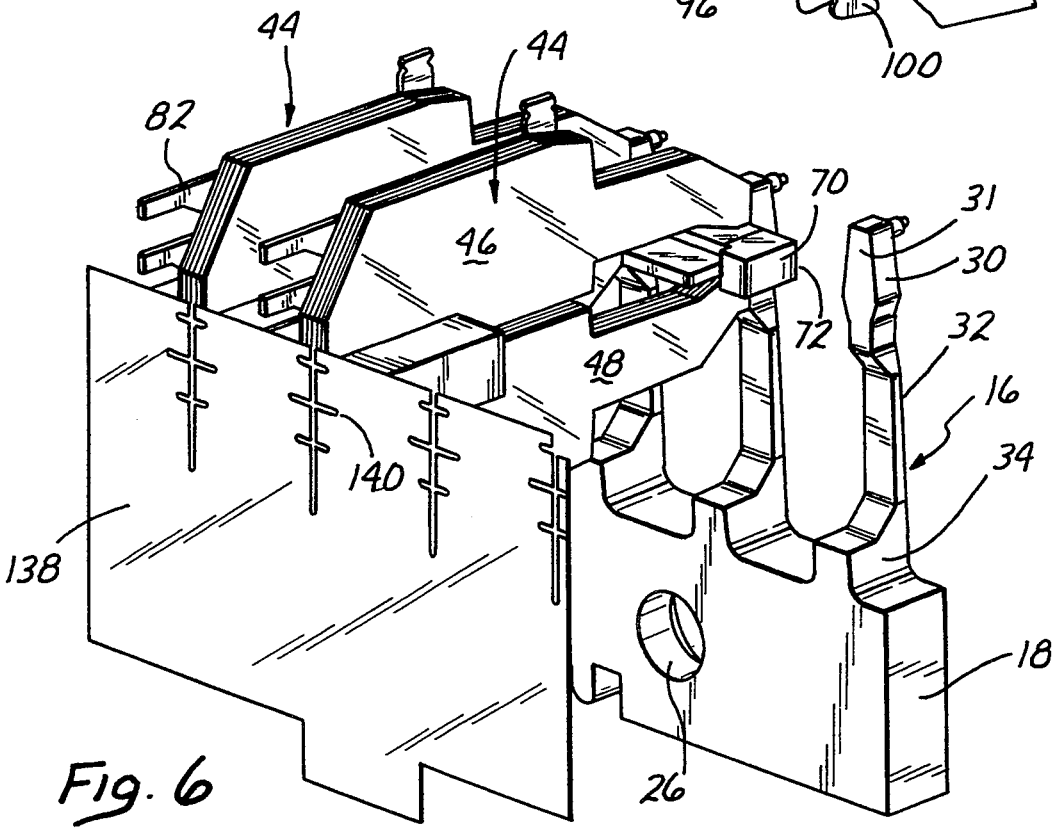
FIG. 6 shows a fragmented perspective view from the side away from the interface of the pole pieces and hammers, with a grounding strip.

The backside of the fret 18 with the hammersprings 16 can be seen more clearly in FIG. 6. In this case, it can be seen that the hammersprings 16 have an enlarged end portion 30. The end portion 30 provides for the mass of the hammerspring being generally oriented toward the driven portion and also the area which must be accommodated for interaction with the magnetics of this invention. The shape and size of the hammersprings can be exemplified in co-pending U.S. Patent Applications by the inventor hereof and James Chon as commonly assigned to the Assignee hereof.

The hammerspring 16 with its enlarged end or head portion 30 is characterized by its expanding fiddle shape that optimizes its configuration for retention by the magnetic field to draw the hammerspring 16 into retention therewith. The hammerspring 16 has a necked down spring portion 32 which tapers from the base of the fret 18 into the end 30. This provides for a uniform spring action and consistent storage of potential energy therein when it is retained by the action of the magnetics hereof. The hammerspring 16 is secured by an enlarged base portion 34 to the base 20 of the fret 18.

The foregoing configuration allows for a fast reactive hammerspring 16 that operates in a highly discrete and accurate manner.

At the end of the hammerspring is a printing pin or rod 38. The pin or rod 38 is formed with a tip 40 and an enlarged expanded reinforcing gusset 42. The pin 38 has its enlarged gusset 42 formed during a welding process as described in a co-pending application commonly assigned herewith.

The tip 40 with its expanded gusset 42 allows for the impact of the tip 40 in a manner to effectuate a strong and firm impact while at the same time maintaining the pin 38 in fixed position as welded to the enlarged portion 30 of the hammerspring 16. The pin 38 can be formed of a tungsten carbide material and welded in a process as exemplified in the foregoing case set forth herein showing the welding process for welding the pin 38 to the end of the hammerspring 16.

A unique portion of this invention comprises the pole pins or pole pieces in their configuration as well as their overall orientation with respect to each other. These pole pins or pole pieces can be seen generally as pole pins or pieces 44. The pole pieces 44 are aligned in such a manner as to form a top pole piece 46 and a bottom pole piece 48. These respective pole pieces 46 and 48 forming the respective top and bottom pieces provide a magnetic circuit that operatively retains the hammersprings 16 into juxtaposition therewith by the magnetic circuit as detailed hereinafter.

Figure 8:
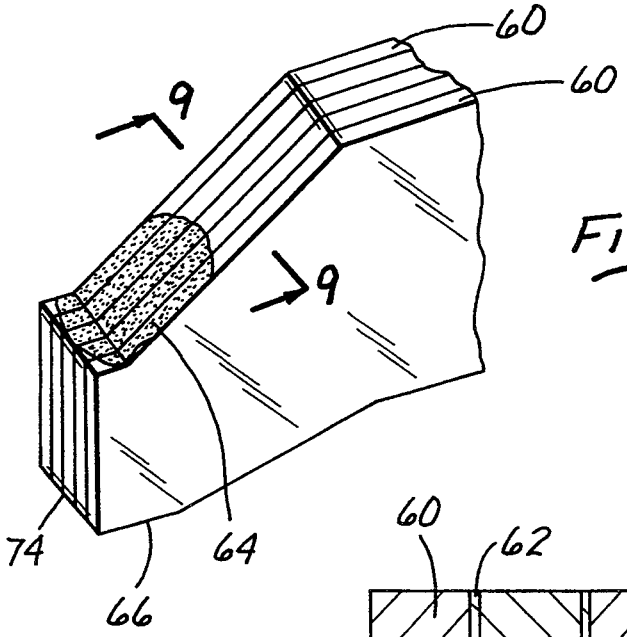
FIG. 8 shows a perspective view of the ends of the pole pieces with the welding across the ends thereof.
Figure 9:
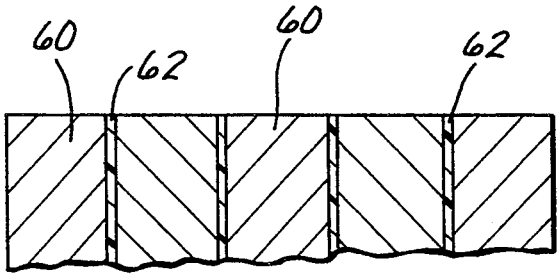
FIG. 9 shows a sectional view of the laminations of the pole pieces taken in the direction of lines 9—9 of FIG. 8.

The pole pieces 46 and 48 are formed from a sandwiched laminate which will be detailed hereinafter and can be seen in greater detail in FIGS. 8 and 9.

The pole pieces 46 and 48 provide for a space or magnetic air gap 50 between them which receives a permanent magnet 52. The space 50 between the pole pieces 46 and 48 with the permanent magnet 52 creates a space in conjunction with a shunt 54 of the pole pieces when placed in juxtaposition with each other so as to allow for the magnetic functions as shall be described hereinafter. The permanent magnet 52 is designed so that magnetic flux flowing through the pole pieces 46 and 48 reacts with the end 30 of the hammerspring to create the magnetic retention as described hereinafter.

The pole pieces 46 and 48 with the shunt 54 when placed in the overlying position provide for a shunt 54 and air gap or parallel shunt gap 56. The air gap 56 of the shunt 54 is approximately 0.030 inches wide. The space or air gap 50 of the permanent magnet 52 is approximately 0.120 inches. As a consequence, the difference between the air gap 56 of the shunt 54 and the air gap in the space 50 of the permanent magnet 52 is approximately a one to four ratio. This ratio can be extended to be a ratio of one to two (1:2) going up to one to six (1:6) between the shunt air gap 56 and the gap 50 of the permanent magnet 52. Also important in the design is that the shunt gap (0.030) is approximately equal to the sum of the two working air gaps at the ends of the pole pieces, i.e. ends 74 and 76 as relate to the end of the hammerspring 30 when the hammerspring is in its fully opened position as in FIG. 3. The magnetic energy in the shunt gap 56 is approximately equal to the magnetic energy in the operation gaps between the ends 74 and 76 of the pole pieces 46 and 48 and the end 30 of the hammerspring when the hammerspring is in the fully opened position.

Figure 3:
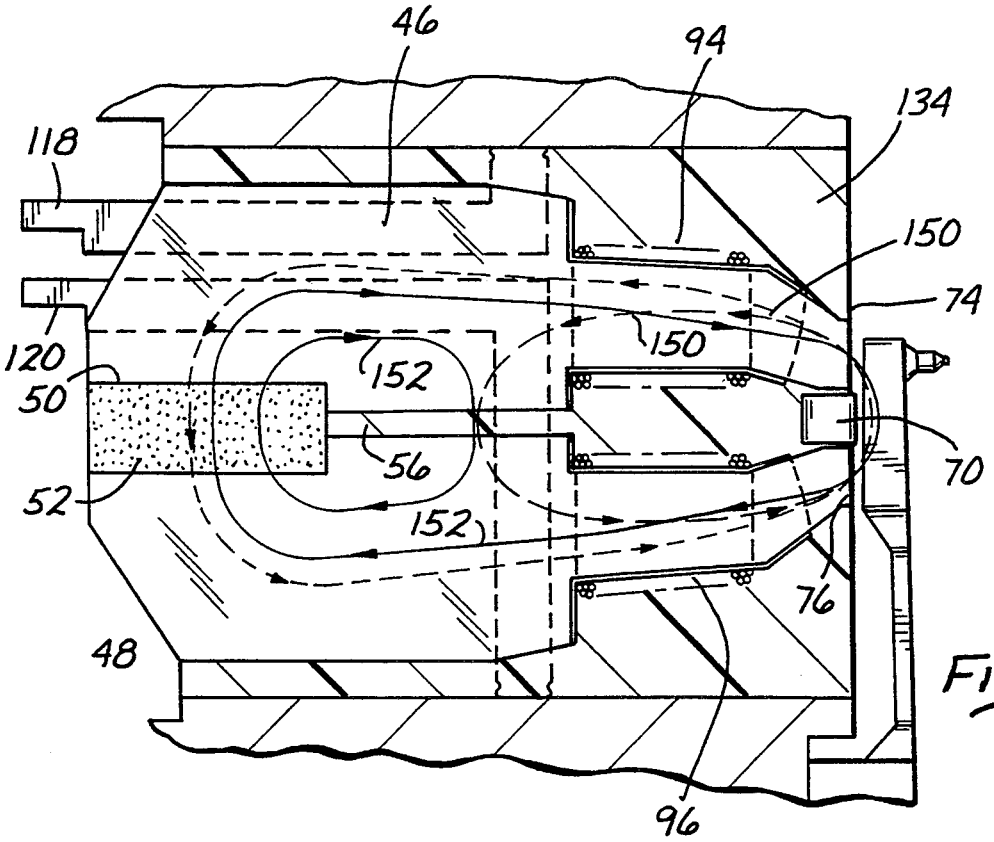
FIG. 3 shows a detailed view of the hammerbank magnetics as seen in FIG. 2, with a release of the hammerspring indicating the flow of flux established by the coils to overcome the flux of the permanent magnet for release of the hammerspring for printing purposes.

In effect the ends 74 and 76 of the pole pieces 46 and 48 are at the saturation mode during operation. Thus the working air gap between the ends 74 and 76 and the hammerspring 30 should equal the shunt gap 56. The working air gaps at the ends 74 and 76 are established when the hammersprings are in the fully opened position as in FIG. 3. The shunt gap is 0.030 inches, and the two working air gaps at the ends 74 and 76 when fully opened as in FIG. 3 are in the range of 0.014 to 0.015 making a total of the working air gap of 0.030 which equals the shunt gap 56 of 0.030. This shunt effect with the working air gaps provides for a substantially improved magnetic function for the retention and release of the hammersprings 16.

The foregoing ratios are predicated upon the mass of the hammerbank 12 in conjunction with the entire mass including the mass of the pole pieces 44 taken in conjunction with the remaining portion of the mass of the hammerbank. This should be understood to be a factor that is controlled by the entire movement of the mass of the hammerbank in a reciprocal lateral manner across the print station and must be such wherein it accommodates the ability to drive the hammerbank in a reciprocal manner across the print station.

The pole pieces 44 are formed by preparing a number of low hysterisis high saturation low carbon silicon-iron laminations. These laminations are formed from a number of low carbon silicon-iron pieces or laminated portions 60. These are shown sandwiched together at an interface of insulation material 62. This is exemplified in FIGS. 8 and 9. The low carbon silicon-iron is formed into a number of sheets 60 that are stamped or formed in any suitable manner to create the pole pieces 44 when sandwiched together. The material is relatively soft and is welded together to maintain them in juxtaposition to each other.

The reason for the high permeability low hysterisis, high saturation, low carbon silicon-iron sandwich is to allow for magnetic forces in the fields required of this invention to pass through the pole pieces yet at the same time not to create large scale eddy currents. The large scale eddy currents are avoided by the lamination configuration.

In order to form the laminated pole pieces with the laminated or sandwiched portions 60, they are initially provided with a coating in the form of a clay or frit that has been coated on the laminations 60. The clay or frit can be seen as part of the interfacing material 62 between the sandwiched portions 60.

After the sandwiched portions 60 are placed in juxtaposition to each other they are welded with a weldment or weld point 64 at the top of the pole pieces 44 and also at the bottom 66 by a laser welding process. This laser welding process effectuates a weldment to secure them into tightened sandwiched juxtaposition. Welding of the other portions of the pole pieces 44 can take place at points along the extent of the pole piece in order to secure them properly. Thereafter, the pole pieces 44 are heat treated.

During the heat treating process, some of the clay or frit can be burned out at the interfacing material 62. At this point, the pole pieces 44 are placed in a vacuum with epoxy in order to that proper insulation takes place in the form of the final insulation material 62. Thus, for those portions of the frit insulation material 62 that have been displaced by the heat treating process namely the clay and the frit having been burned out, the epoxy thereafter provides for insulation to help eliminate eddy currents.

When the hammersprings 16 retract, they have a tendency to retract with substantial kinetic energy. In order to provide for a stop to prevent damage to the ends of the pole pieces 44, an inconel material in the form of inconel block or anti-wear bar 70 is provided. The inconel block 70 is between the ends of the pole pieces 44 which are relatively soft, and can be damaged upon impact. The inconel block 70 forms an impact block against which the hammers with their kinetic energy can impact without doing undo damage to the softer ends of the pole pieces 44.

The inconel block 70 is provided with a chrome plating in the form of chromium nitride. The ends of the pole pieces 74 and 76 are also plated with a chrome nitride material to provide for increased longevity. Accompanying this chrome nitride plating is a chromium nitride plating on the innersurfaces 31 of the enlarged heads 30 of the hammersprings 16. This accommodates the impact and increased wear with the innersurface or hammerspring face 31 when it contacts the face of the inconel block 70.

The pole pieces 44 are formed in a configuration having an enlarged midsection 80 which accommodates the shunt 54 and the air gap 56 as well as the space or gap 50. The rear end section of the enlarged pole pieces overlying the gap 50 has a tapered or chamfered sloping portion 82 at the ends thereof. This chamfered or tapered portion 82 allows for a decrease in the requirements for magnetic flow passage than if the enlarged midsection or portion 80 were formed with a rectangular or squared portion instead of the slope or chamfer 82. It should be understood that this taper 82 is distal from the ends of the pole pieces 74 that are proximate the hammerspring enlarged portions 30.

Toward the ends 74, extending from the midsection 80, a necked down portion or terminal stub 84 is provided forming an extension of the poles pieces toward their ends 74 and 76. These stub portions 84 are formed with a stepped portion 88 from the enlarged portion or section 80 and slope downwardly at portion 90 toward the ends 74 and 76. This has been shown in greater detail in FIG. 7.

Figure 5:
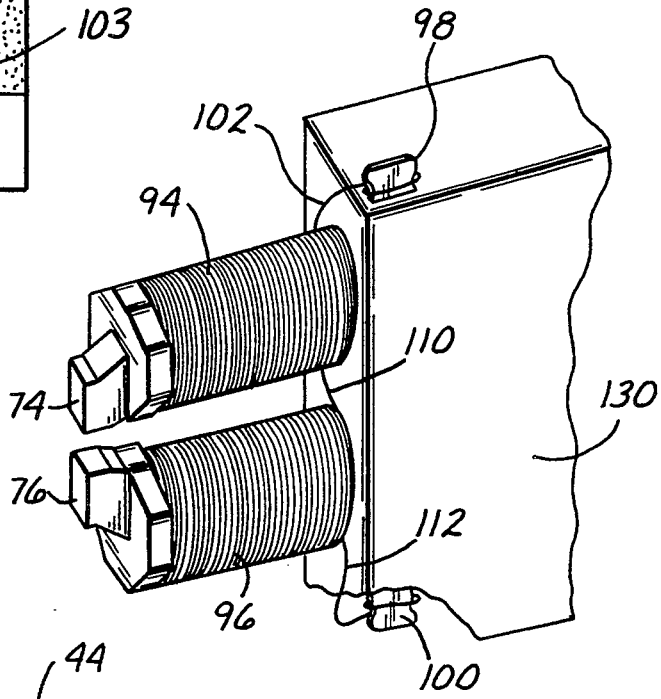
FIG. 5 shows a detailed view of the coils and pole pieces of this invention with the respective wiring thereof.

The necked down portions or stubs 84 terminate at the ends 74 and 76 in such a manner as to allow for a winding of coils 94 and 96 thereon as seen in FIG. 5. The winding of the coils 94 and 96 are formed as one continuous winding starting at a terminal 98 and terminating at terminal 100. This winding can be seen as a wire 102 extending from the terminal 98 to which it is wrapped around the upper stub 84 and then continues with a lead 110 through coil 96 to lead 112 and terminates in a connection at terminal 100.

The terminals 98 and 100 can be seen terminating at connection end terminals respectively 118 and 120. These terminals 118 and 120 are connected to a source of power in order to energize the coils 94 and 96 to create a release of the hammersprings 16 by overcoming the permanent magnetism of permanent magnet 52 through the pole pieces 44. This will be detailed hereinafter in greater measure to effectuate a further understanding of the improved aspects of this invention.

The pole pieces 44 with the terminals 118 and 120 are placed in an epoxy and potted. This can be seen as the epoxy potting compound 130 of FIG. 5 in which the pole pieces 44 are potted as well as the permanent magnet 52. After the potting compound 130 pots the pole pieces the stubs 84 remain extending from the pole pieces with the coils 94 and 96 thereon. The entire potted pole pieces with the potting 130 therearound are then potted within a material 134 to encapsulate the entire series of pole pieces within the hammerbank 12.

In order to provide for a grounding of any stray transients, a stainless sheet or strip 138 is provided having slots or joints 140 in the form of horizontal slots and vertical slots. These horizontal and vertical slots are filled with silver solder to connect the pole pieces 44 thereto and thereby electrically shorting them to the frame and/or the enlarged portion 18 of the hammersprings 16. This shorting creates an electrical loop from the hammersprings 16 through the strip of stainless steel 138 with the silver solder connecting the pole pieces 44 so that the coil capacitance currents during the action of the hammerspring 16 will be conducted to ground. This extends the life of the hard facing material by eliminating arcing during the opening of the hammerspring.

The coils 94 and 96 provide for a reversal of the flux in the pole pieces 44 caused by the permanent magnet 52. This reversal of the flux is indicated by arrows 150 which flow not only through the air gap 50, but also through the shunt air gap 56. This serves to overcome the field provided by the permanent magnet 52 and the magnetic forces in the direction of arrow or line of flux 152 that is derived from the permanent magnet 52 going through the pole pieces 46 and 48 and interconnecting and holding the hammerspring 16 into retention against the inconel block 70.

OPERATIONAL CHARACTERISTICS

The hammersprings 16 are retracted and retained by the magnetic forces of the permanent magnet 52 as shown by the lines of flux 152 passing respectively through the shunt air gap 56, the air gap 50, the working gaps between the ends of the pole pieces 74 and 76 as well as through the enlarged portion 30 of the hammerspring 16. It can be seen that the retention is against the inconel block 70, and there is a minor clearance at the ends 74 and 76 of the pole pieces and the end 30 of the hammerspring. The stored mechanical or potential energy of each hammerspring 16 is released or fired by causing the current to flow through the dual coils 94 and 96 by providing a current at terminals 118 and 120. The current flows continuously through one coil to the next. This creates the reverse magnetic flux in the direction of flux lines 150 which overcomes the magnetic flux of the permanent magnet 52 flowing along flux lines 150.

The potential energy of each hammerspring is then converted to kinetic energy by moving the ends or the tip 40 of the hammerspring 16 for printing purposes as in FIG. 3. After the tip 40 produces a dot by impressment against the ribbon and contacting the paper, the hammerspring 16 is returned to the pole piece position against the inconel block 70. The excess kinetic energy tends to shorten the cycle time, but creates wear of the magnetic circuit pole piece ends 74 and 76 upon impact. This wear is significantly decreased by the platings or coatings on the appropriate surfaces including the inconel block 70.

The frame which comprises the hammerbank 12 does not have any steel in contact with any of the neighboring magnetic circuits. Thus, magnetic interaction is very low. This is enhanced by the frame being made from a non-ferrous alloy and the potting material 130 being of a non-conducting non-magnetic nature. Thus, the hammersprings 16 can be fired independently so that uniform darkness and density will occur regardless of dot spacing density.

The inconel block or anti-wear bar 70 is of a non-magnetic material preferably non-conducting inconel, multicrystalline aluminum oxide or stabilized zirconium oxide. This is important to protect the ends 74 and 76 of the pole pieces from being impacted by the ends 30 of each hammerspring 16. This is particularly advantageous since the pole pieces 46 and 48 are made from a low hysterisis, high saturation low carbon silicon-iron, and are relatively soft. This relatively soft material is protected from such impact by not only using the anti-wear bar 70 but also by plating the ends with the low friction very hard chrome, chrome nitride surface, or titanium nitride, or titanium carbon nitride or other suitable coatings of up to twelve microns thickness.

The pole pieces 46 and 48 are made from the low hysterisis, high saturation, low carbon silicon-iron laminations so that the electrical energy required to release the hammersprings 16 can be decreased by minimizing the eddy current loses. The pole pieces 46 and 48 are welded along their end regions such as at their weld points 64 and 68 in a manner orthogonal to the pole piece and hammerspring interface portions defined by the enlarged portion 30 and surface 31.

When the hammersprings 16 are released they create a circular electric field by the changing magnetic flux. The welding at the ends at points 64 and 66 diminish the arc that would be caused by the released hammerspring 16. In effect, when each hammerspring is released through the action of the coils 94 and 96 generating a flux in the direction of arrows 150, a changing magnetic flux is encountered through the circular magnetic fields. This would normally create an arc to the releasing hammersprings thereby wearing the surfaces 31 of each hammerspring. By welding the ends 64 and 66 with the laser welding, this diminishes the arcing effect when releasing the hammerspring 16.

Please note that this circular electric field is normally in the plane of the pole piece 46 and 48 but can jump to and from the leading hammerspring face 31 to complete a circuit. This welding produces a high resistance shorted turn. This serves to prevent mechanical erosion of the component materials and pitting of the face 31 as well as the ends 74 and 76 of the pole pieces 44 and the inconel block 70.

In order to diminish the arcs that pit or disrupt the hard surface coatings, another precaution is undertaken in the way of grounding the pole pieces 46 and 48 to the hammersprings. As previously stated, this is accomplished by the stainless steel strip 138. This grounding of the strip 138 through the silver solder joints or slots 140 by the strip 138 being in contact with the frame grounds the pole pieces 46 and 48 to the hammerspring 16. As the voltage is applied to the dual coils 94 and 96 the current increases therethrough and at the same time the net magnetic flux in the directions of arrows 152 is decreased. This net magnetic flux is the sum of the flux due to the permanent magnet 52 and dual coil current that produces the opposite magnet flux in the direction of arrow 150. The decreased magnetic force by the opposite magnet fluxes thereby releases the hammerspring 16 and causes it to move from the pole piece locations 74 and 76 before cancellation of the field takes place. This is exemplified in FIG. 3 wherein the reverse flux 150 has caused the hammerspring 16 to be released from its retention.

At this same time, there is a capacitive dielectric current formed by the capacitance between the dual coils 94 and 96 and the pole pieces 46 and 48. This capacitance current flows through the hammerspring ends if the pole pieces are not well grounded to the hammerspring by an alternate path. The capacitance current will create arcs from the pole pieces 74 and 76 to the hammerspring 16 end surface 31 and disrupt or pit the coating thereon. This can effectively erode and thereby affect the proper timing and the energy response of the hammersprings 16. Thus, by diminishing the arcs by grounding the hammersprings and the pole pieces 46 and 48 through the strip 138 to the frame, arcing and thereby geometry changes and magnetic metal debris is diminished between the pole pieces 46 and 48 and the hammerspring end surface 31.

The design of the pole pieces 46 and 48 creates a heavy shunting magnetic path for the permanent magnet 52. The magnetic circuit through the pole pieces 46 and 48 and the hammerspring end 30 through the working gaps at ends 74 and 76 is dictated by the size and shape of the end of the hammerspring in order for it to support the flux required for retraction and subsequent retention without excessive magnetic saturation. At the same time, it must be small enough to allow for the desired frequency response of the hammerspring 16 in its movement to impact the ribbon with the tip 40. This frequency response is dictated by the effective mass of each hammerspring which is primarily at the end 30 where the flux passes in and out of from the ends of the pole pieces 74 and 76 through the working gaps.

The magnetic field energy developed in the air gap 56 and between the pole piece ends 74 and 76 and the release and impacting hammerspring 16 must be sufficient so that the change of this field energy with respect to the gap difference will create sufficient force to retract the hammerspring all the way to the pole piece location against the impact bar or block 70. This magnetic force or magnetomotive force (mmf) is developed by sizing the permanent magnet 52 and creating the low reluctance path through the pole pieces 46 and 48 to the end 30 of the hammerspring.

The mmf of the permanent magnet 52 is determined primarily by the working air gaps between the pole pieces 74 and 76 and the hammerspring enlarged portion 30. The magnetic length of the magnet 52 or what in this configuration would be the cross section, is determined with respect to any permanent magnet 52 as to its own particular coercive force and b field. When the length of the magnet 52 and the magnetizing direction is determined, the cross sectional area in contact with the pole piece magnet iron at the ends 74 and 76 is then available to lower the reluctance seen by the two releasing dual coils. This is due to their requirement to generate an equal and opposite flux density in the direction of arrow 152 to oppose the flux in the direction of arrow 150. Thus at this point, the net flux between the flux in the direction of arrow 150 and 152 approaches a nominal or zero amount during the flight of the hammerspring 16 and subsequent impact with the inked ribbon and paper at the tip 40. The reluctance seen by the dual coils 94 and 96 as the hammerspring 16 is being released varies. The reluctance is the sum of two primary working air gaps formed by the permanent magnet 52. From the foregoing, the invention hereof lowers the magnetic reluctance as seen by the dual coils 94 and 96 by having an additional shunt gap 56. The shunt gap's distance 56 is equal to the total gap distance of the total working air gap between the ends of the pole pieces 74 and 76 and the hammerspring end 30. The shunting air gap is in parallel with the permanent magnet 52 air gap 50. All gaps including the magnet air gap 50 have a permeability of air as long as the magnet is not being coercively magnetically polarized. Thus, the shunt gap 56 is in parallel with the magnet air gap 50 and reduces the equivalent reluctance by the parallel rule.

The permeabilities and the areas of these air gaps are approximately equal. Thus, the reluctance is then proportional to the product of the lengths divided by the sum of the lengths. After final optimization considering all the required mmf and flux densities, along with the numerous permeabilities of the non parallel air gaps it was found that the shunt gap length should be one quarter and therefore the resulting reluctance was decreased to one fifth of the previously required reluctance. This is a dramatic change over the prior art.

Figure 4:
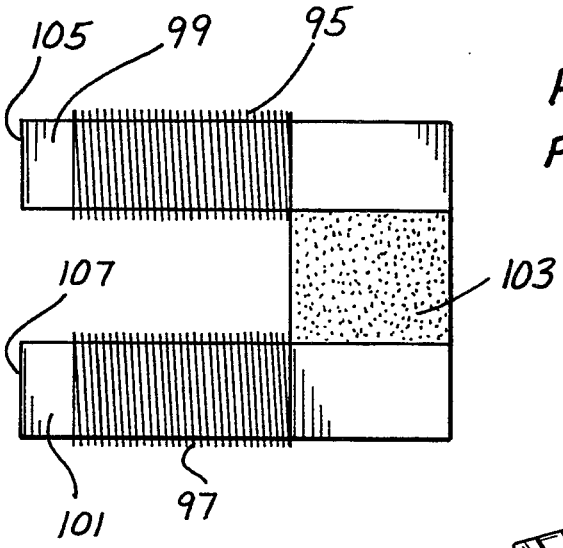
Fig. 4 PRIOR ART
FIG. 4 shows the prior art as to pole pieces with a permanent magnet and coils.

In reference to the prior art, it can be seen in FIG. 4 where the coils 95 and 97 are on a pair of poles or stubs 99 and 101. These poles 99 and 101 have a permanent magnet 103 therebetween which has the same function of holding the hammerspring 16 at the ends 105 and 107 thereof. However, due to the respective lack of shunts, design of the pole pieces 99 and 101 and the characterization that eliminates a laminate, the foregoing requires substantially greater energy. This substantially greater energy through the coils 95 and 97 creates substantially greater heat and poor operation due to increased impact against the ends 105 and 107 and large retention requirements of the permanent magnet 103 and field generated through coils 95 and 97.

When the dual coils 94 and 96 of this invention have current passing therethrough, the only significant reluctance since the working air gap is closed at this time, is the parallel shunt gap 56 and the gap 50. Thus the initial reluctance has been decreased by eighty percent (80%) with respect to the non shunt design of the prior art as seen in FIG. 4.

The releasing reluctance is the addition of the equivalent parallel reluctance through shunt gap 56 and gap 50. Since the reluctance of the final air gap normalized to the magnet air gap 50 is approximately one, then the average change in the reluctance of the situation without a shunt varies from 1 to 2 and with the shunt varies from 0.2 to 1.2. The ratio of the two area's changing reluctance normalized to the same dual coil current time period is 0.7 divided by 1.5 or approximately 0.47. Thus, an average new reluctance of the shunted magnetic circuit of the electrical dual coil's 94 and 96 mmf has been reduced to 0.47 of the case without the shunt such as in the prior art shown in FIG. 4. This result is effectively used to decrease the number of turns or the current required through the dual coils 94 and 96 which of course lowers the total power and the heat required to operate the magnetic circuit.

A further point of note is that the advantageous location of the shunt 54 between the permanent magnet 52 and the dual coils 94 and 96 enhances the operation of the circuit. The reason for this is that the magnetic iron path across the face of the magnet 52 to a proposed shunt below the magnet would be the sum of the two dual coil's 94 and 96 current fluxes. The permanent magnet flux of magnet 52 could possibly go into unwanted saturation. In order to avoid this, additional steel required of the pole pieces would have to be used and would increase weight. By placing the shunt 54 between the permanent magnet 52 and the dual coil's 94 and 96, this undesirable result is avoided.

From the foregoing, it can be seen that this invention is a significant step over the art by providing for enhanced magnetic functions for a hammerbank in a dot matrix printing system which has not been seen in the prior art. Consequently, it is believed this invention should be read broadly in light of the following claims.

I claim:

1. A low reluctance magnetic circuit for a dot matrix line printer for retaining hammersprings by said magnetic circuit comprising:

a pair of pole pieces formed of a magnetically conductive metal with ends proximate the hammersprings, having a space between them with a permanent magnet emplaced in said space;

a coil wrapped around a portion of each of said pole pieces between the magnet and said ends thereof to provide a reverse magnetic field to the magnetic field provided by said permanent magnet through said pole pieces; and, a metallic magnetic shunt between said pole pieces.

2. The circuit as claimed in claim 1 further comprising;

said pole pieces are formed of sheets of metal sandwiched together.

3. The circuit as claimed in claim 2 further comprising;

insulation between said respective sheets of metal.

4. The circuit as claimed in claim 3 further comprising;

said pole piece ends placed in proximity to one of said hammersprings, and having a hardened surface thereon.

5. The circuit as claimed in claim 1 further comprising;

an anti-wear bar between said ends of said pole pieces in proximity to said hammersprings which extends beyond the ends of said pole pieces.

6. The circuit as claimed in claim 1 wherein:

said pair of pole pieces have a magnetic shunt between them with a space one sixth (1/6) to one half (178 ) the space with said permanent magnet.

7. The circuit as claimed in claim 1 wherein:

said pole pieces are placed within a non-conductive plastic material and surrounded by a magnetically non-conductive hammerbank in order to isolate said pole pieces with respect to each other.

8. The circuit as claimed in claim 1 in combination with said hammersprings for printing in a dot matrix printer wherein:

said hammersprings have been grounded to said pole pieces to prevent arcing upon release of said hammersprings from said pole pieces.

9. The circuit as claimed in claim 2 further comprising;

a welded portion welding an area proximate the ends of said pole pieces between each respective sheet of metal.

10. A dot matrix printer having a hammerbank which reciprocates to provide printed dots against a piece of paper on a platen wherein the improvement comprises:

a hammerbank having a plurality of hammersprings mounted thereon adapted for magnetic retention;

pairs of pole pieces respectively having ends in proximate relationship to said hammersprings to provide magnetic retention to the ends of said hammersprings and having a space removed from said hammersprings with a permanent magnet emplaced in said space; and, a metallic shunt between said pole pieces for providing a magnetic shunt with respect to said permanent magnet.

11. The printer as claimed in claim 10 further comprising;

a coil wrapped around a portion of said pole pieces connected to terminals having a current source to provide a magnetic flux against the magnetic flux generated by said permanent magnet.

12. The printer as claimed in claim 10 further comprising;

a wear bar emplaced between the ends of said pole pieces against which said hammerspring can retract.

13. The printer as claimed in claim 10 further comprising;

said shunt placed between the ends of said pole pieces and the permanent magnet, and having a gap in said shunt equal to the working air gap between the ends of the pole pieces and the hammerspring.

14. The printer as claimed in claim 12 further comprising;

a plated surface on said wear bar and the hammerspring impacting against said wear bar in the form of a chrome surface selected from the group of chrome nitride titanium nitride or titanium carbon nitride.

15. The printer as claimed in claim 10 further comprising;

a plurality of hammersprings formed on a fret attached to the hammerbank in a plurality of hammersprings attached to a single fret.

16. The printer as claimed in claim 10 further comprising;

pole pieces formed from laminated sheets of magnetically conductive metal having insulation between each laminated sheet.

17. The printer as claimed in claim 16 further comprising;

electrical contact means joining each respective sheet of said pole piece for grounding charges at the end of said pole pieces.

18. The printer as claimed in claim 16 further comprising;

a ground means between said pole pieces and said hammersprings to reduce arcing when said hammersprings are released.

19. A plurality of pairs of magnetically conductive pole pieces in combination with a hammerspring on a hammerbank for a line printer wherein said hammerspring is connected to said hammerbank at one end and provided with a tip distal therefrom for printing against a print ribbon for printing on paper wherein the improvement comprises:

pairs of pole pieces providing a magnetic circuit having a space between the pair proximate one end with a permanent magnet emplaced therein, and ends distal therefrom for providing a magnetic retention force to said hammerspring; and, a metallic shunt between said pole pieces.

20. The combination as claimed in claim 19 wherein;

said pole pieces are formed from laminated sheets of magnetically conductive metal.

21. The combination as claimed in 20 further comprising;

an impact bar emplaced between the ends of said pole pieces for said hammerspring to impact thereagainst.

22. The combination as claimed in claim 20 further comprising;

a coil wrapped around each of said pole pieces connected to a power source.

23. The combination as claimed in claim 20 wherein:

said shunt has a gap of one sixth (1/6) to one half (178 ) the gap of the space in which said permanent magnet is emplaced.

24. The combination as claimed in claim 21 further comprising;

a wear resistant plating on said impact bar and said hammerspring.

25. The combination as claimed in claim 20 further comprising;

a conductive surface connected between the ends of said pole pieces to reduce arcing.

26. The combination as claimed in claim 20 further comprising;

means for grounding said hammersprings to said pole pieces.

27. The combination as claimed in claim 20 further comprising;

a hammerbank of magnetically non-conductive material for mounting said pole pieces therein for purposes of magnetic isolation between said respective pole pieces.

* * * * *

UNITED STATES PATENT AND TRADEMARK OFFICE

CERTIFICATE OF CORRECTION

PATENT NO. : 5,344,242

DATED : September 6, 1994

INVENTOR(S) : Norman E. Farb

It is certified that error appears in the above-indentified patent and that said Letters Patent is hereby corrected as shown below:

Column 12 Line 27 of Claim 6 "(178)" should read --(1/2)--.
Column 14 Line 20 of Claim 23 "(178)" should read --(1/2)--.

Signed and Sealed this

Twenty-first Day of February, 1995

*Attest:*

Bruce Lehman

BRUCE LEHMAN

*Attesting Officer*

*Commissioner of Patents and Trademarks*